United States Patent [19]

Bick et al.

[11] 3,951,772

[45] Apr. 20, 1976

[54] SELECTIVE PLATING APPARATUS

[75] Inventors: Maurice Bick, South Orange; Jean A. Lochet, Metuchen; Donald J. Dubas, Maplewood; Richard J. Di Murro, Harrison, all of N.J.

[73] Assignee: Auric Corporation, Newark, N.J.

[22] Filed: May 31, 1974

[21] Appl. No.: 474,952

[52] U.S. Cl. ..... 204/198; 204/15; 204/202; 204/224 R

[51] Int. Cl.[2] ..... C25D 17/28; C25D 5/02; C25D 5/06; C25D 3/48

[58] Field of Search ..... 204/202, 224 R, 206–211, 204/224 R, 198

[56] References Cited

UNITED STATES PATENTS

| | | | |
|---|---|---|---|
| 936,472 | 10/1909 | Pfanhauser | 204/206 |
| 2,591,042 | 4/1952 | Berman et al. | 204/202 |
| 3,008,892 | 11/1961 | Owen | 204/207 |
| 3,649,507 | 3/1972 | Welter | 204/202 |
| 3,691,026 | 9/1972 | Durowachter et al. | 204/28 |
| 3,706,650 | 12/1972 | Eisner | 204/217 |
| 3,904,489 | 9/1975 | Johnson | 204/15 |

*Primary Examiner*—F. C. Edmundson

*Attorney, Agent, or Firm*—Stefan J. Klauber

[57] ABSTRACT

Apparatus for continuous electroplating of selected portions of discrete electronic components. The components are carried by a conveyor belt through an electroplating station where the portions to be plated make contact with a moving porous applicator surface wetted with the electroplating solution, while a D.C. potential is suitably applied. The respective movements of conveyor and applicator surfaces are such that the trace of each conveyed component upon the applicator surface continuously overlies fresh electroplating solution. The conveyor belt passes through a channel in a stationary guide means at the electroplating station, which accurately spaces the components with respect to the applicator and restrains the components from undesired wobble or vertical movements. The leads of the components, which are connected to electrically isolated terminals on the die-receiving face of the component, protrude from the guide as they progress through the channel therein. Electrical contact with the leads, for purposes of plating the isolated terminals, is made by a stationary or moving flexible conductor means, such as a wire brush, which overlies the guide and is supplied with the aforementioned D.C. potential.

14 Claims, 9 Drawing Figures

201
203
205
207
209
211
213
217
219
221
223
225
227
229
233
235
237
239
240
241
242
243
244
245
246
247
248
249
250
251
253
255
257
259
260
261
262
265
267
269
271
273
281
283
285
286
289
290
293
295
297
98
120

SELECTIVE PLATING APPARATUS

BACKGROUND OF INVENTION

This invention relates generally to electroplating apparatus and methodology, and more specifically relates to the electroplating with gold of electronic components or the like.

Gold, within recent years, has become a very important part of the electronics industry. Among those properties recommending its use therein, are its relative unalterability, high solderability and low contact resistance. In the semi-conductor field, gold has furthermore found favor because of its ability to readily form an eutectic alloy with silicon and germanium. In the latter connection it may be noted that most headers or packages for diodes, transistors, and integrated circuits are gold plated as a preparation for the mounting or attaching of semi-conductor devices Such components are exemplified by the well-known line of TO-5 and TO-8 multi-lead headers. Such headers consist of an eyelet of Kovar metal to which several insulated Kovar leads are attached, and sealed in glass.

In accordance with known principles in the art, headers of the foregoing type have, in the past, been plated (among other methods) by so-called barrel plating techniques — that is, by subjecting such articles to electroplating while a plurality of articles tumble in a barrel. These barrel techniques, however, have many important drawbacks, numerous of which are recognized in the art. For example, where headers or the like are thus plated, it is found that many leads do not make electrical contact with the remainder of the load. Where such conditions obtain during the plating cycle, the portion of the lead closest to the anode becomes cathodic. Such leads become bipolar, and at the anodic portion of the leads problems can arise in that the gold may redissolve anodically, and as well base metal can be attacked to expose bare spots. Where the tumbling action is markedly inadequate these problems can become quite severe. In the past these problems have partially been overcome by incorporating mechanical means for improving electrical conductivity through the load. Such means have taken the form of metal particles or metal shot. Unfortunately during plating operations the shot itself becomes gole plated, resulting in the loss of gold and attendant increase in the cost of plating the desired objects, that is, the headers, etc.

Within recent years, particularly because of the soaring price of gold, it has furthermore been increasingly appreciated that barrel plating techniques (and as well, common rack plating techniques) are exceedingly wasteful of the gold itself. If one considers, for example, the most common use of barrel plating in the electronic industry, i.e. the plating of the aforementioned headers, it will be appreciated that basically one is only interested in providing a plating at the die-receiving face thereof, and at the contact connections for the header leads which are present at the said face. Barrel plating techniques, however, are such that the entire header is plated with gold — including all electrically conductive, accessible portions thereof. Furthermore, since barrel plating is based upon the development of multiple electrical contacts among the tumbling components, it is basically a statistical process, this is to say that different components in a tumbled load may be subjected to markedly different plating times. In order to achieve a desired mean plating thickness, it is therefore necessary to grossly overplate, in order to assure that all of the individual components in the batch receive adequate plating, it is frequently necessary to overplate many of the components by as much as 10% to 20%. This is obviously a further waste of the precious gold material.

In the copending patent application of Frank J. Johnson, filed July 13, 1973, and entitled "Apparatus and Method for Continuous Selective Electroplating", Ser. No. 379,113, now U.S. Pat. No. 3,904,489 which application is assigned to the same assignee as the instant application, there is disclosed apparatus and method which are highly effective in overcoming the foregoing problems of the prior art. The said apparatus in particular, is adapted to enable continuous electroplating of selected portions of discrete electronic components or the like. In accordance with the Johnson apparatus a plating belt adapted for carrying electroplating solution on the surface thereof, is continuously moved through an electroplating station. Electroplating solution is applied to the belt at a point in the progression thereof which is upstream of the electroplating station, as for example, by passing the belt (which may be in the form of a loop) through a reservoir for the solution. The discrete components to be selectively electroplated are arrayed in a line, and are conveyed across the surface of the moving plating belt, with the portions of the components to be plated in contact with electroplating solution on the belt. The direction of movement of the components is generally counter to the movement of the plating belt, and is more specifically at a skewed direction with respect to the direction of movement of the said belt. The angle of skewing in relationship to the speed of progression of the plating belt and of the components, is such that the trace of each component upon the plating belt continuously overlies fresh electroplating solution; which is to say that the various components are continuously wiped by fresh electroplating solution. A D.C. electrical potential appropriate to enable the desired electroplating, is applied between the component portions to be plated and the backside of the plating belt.

In accordance with the concepts set forth in the said Johnson application, the means for conveying the discrete components through the electroplating station preferably comprise a pair of parallel moving conductive belts, the spacing between the belts defining openings for supporting the components to be plated. The portions selected for plating therefore project beneath the conductive belt during passage through the station. As the borne components approach the station in Johnson an electrically non-conductive gripper belt passes atop the components as to sandwich same with the pair of conducting belts underlying the component. In order to effect electrical contact with the wire-like leads which extend upwardly from the conveyed components, a further movable belt, provided with a resilient conductive surface contacting the leads, is made to move with the conductive and gripper belts through the electroplating station.

While the aforementioned Johnson apparatus has, as indicated been found effective for its purposes, it has nevertheless been observed that the apparatus is less than ideal as respects performance and reliability characteristics thereof. A principal difficulty arises from the conveying system, which is overly complex — as regards its basic mode of transporting the said components. The parallel moving belts, for example, require frequent adjustment, and relatively minor imperfections in the belts or in their relative spacing or rates of movement, can lead to lack of uniformity in the plating of individual components. It is, furthermore, difficult with the relatively flexible Johnson conveying arrangement, to provide and maintain accurate spacing from the solution applicator belt as the components pass through the plating station; and indeed the components may even undergo wobble about their longitudinal axis due to the absence of restraint against such motions. Similarly, application of electrical potential to the conveyed workpiece is effected in relatively complex fashion — which can comprise an additional impediment to dependability of performance.

In accordacne with the foregoing, it may be regarded as an object of the present invention to provide apparatus enabling on a mass production basis, the electroplating of selected portions of electronic components or the like, thereby eliminating the waste of plating metals previously occurring where the said components were subjected to gross plating thereof.

It is a further object of the present invention, to provide apparatus enabling selective electroplating of electronic components or the like with gold, or similar precious metals, which apparatus enables such operations on a continuous basis, which results in platings of excellent quality and carefully controlled thicknesses, and wherein the uniformity of plating thickness and quality from piece to piece is correspondingly high.

It is a yet further object of the present invention, to provide apparatus for selective electroplating of electronic components or the like, which is of improved dependability of operation in comparison to prior apparatus, and which is greatly simplified in comparison to such prior apparatus, thereby enabling greatly increased effectiveness in realized results.

SUMMARY OF INVENTION

Now in accordance with the present invention, the foregoing objects, and others as will become apparent in the course of the ensuing specification, are achieved in apparatus which in gross form is similar to the Johnson apparatus previously described herein, but which utilizes greatly improved sub-systems for conveying the components to be treated to and through the electroplating station portion of the said apparatus, and for maintaining an electrical potential at the portions of the components which are to be plated. In accordance with the improved apparatus, but a single moving belt need be provided for conveyance of the workpieces. This workpiece conveying belt preferably is in the form of a one-piece closed loop, which is provided with a plurality of circular or other shaped openings for receiving the headers or similar electronic components which are to be plated. The components rest via their lip or rim portions in the belt openings, with their die-receiving faces protruding through the openings for contact with the electroplating solution applicator belt. A stationary conveyor belt guide means is provided at the electroplating station, so that the conveyor belt passes through the said guide, which accurately positions and maintains the components with respect particularly to the applicator belt, as the components pass through the station. This guide means may thus include a channel, the walls of which at least partially overlie the lips or rims of the conveyed components, to thereby restrain movement of the components in other than a line direction through the guide. The guide channel is open at its top side so that the leads of the components may protrude above the guide as the components progress therethrough. Electrical contact with the protruding leads is made by a flexible conductor means, such as a wire or metal mesh brush. The said brush in one embodiment of the invention may comprise a stationary element overlying the guide; or in a further embodiment the brush may be formed on the surface of a lead contact belt which moves through the plating station, parallel to and at about the speed of the speed of the conveyor belt, directly above the said guide.

In accordance with another aspect of the present invention a greatly simplified electroplating solution applicator means may be utilized. In particular the plating belt heretofore employed in connection with the Johnson apparatus, may be replaced by a generally cylindrical roller applicator. The latter may be formed of an electrically conductive cylinder which is provided with a fabric or fibrous covering capable of retaining electroplating solution applied thereto. The roller is rotated during use, with a portion thereof being in contact with the electroplating solution reservoir; or the electroplating solution may be applied to the roller surface through other means, as for example, by a header discharging onto the roller. A suitable potential is applied to the underlying conductive cylinder as the components to be plated are passed in array fashion across the roller. The axis of the roller during this operation is preferably oriented parallel to the direction of movement of the components; and the rate of rotation of the cylinder in comparison to the rate of progression of the components is such that the trace of each said component upon the solution-bearing surface of the cylinder continuously overlies fresh electroplating solution.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
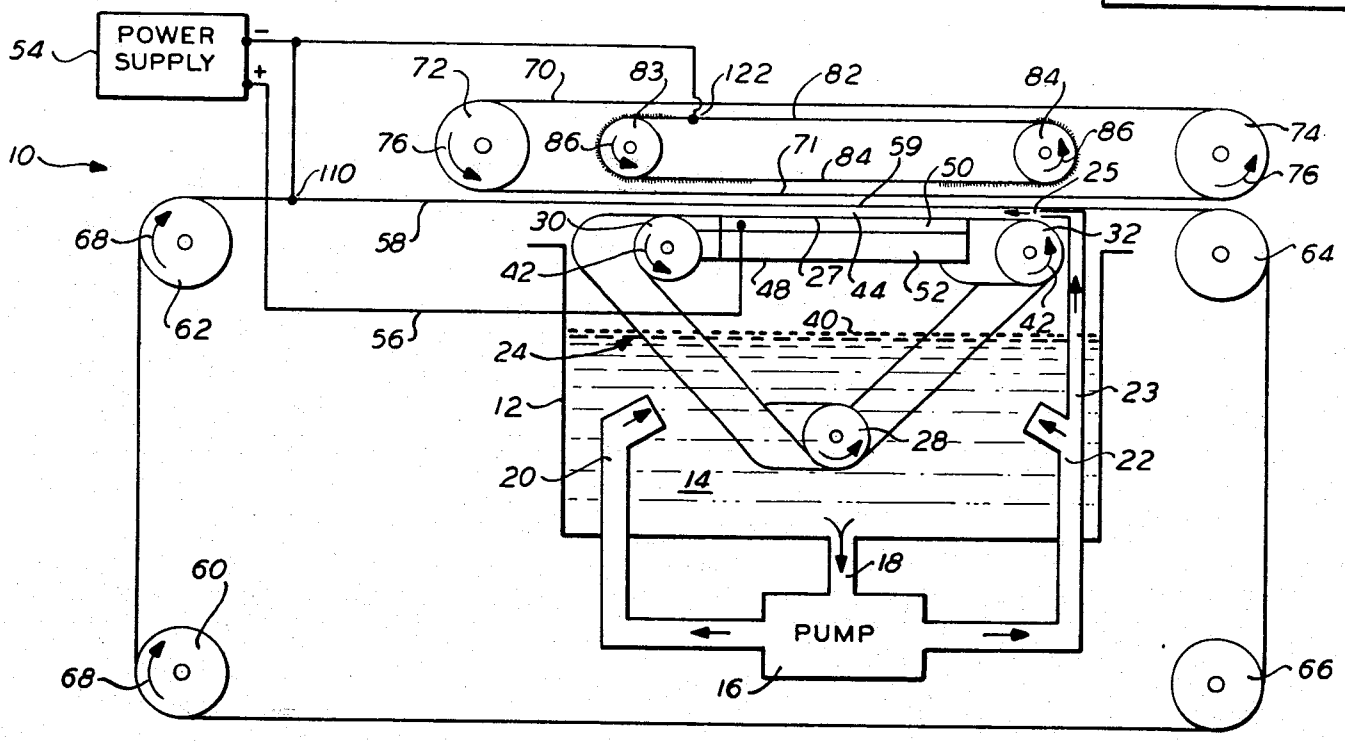
FIG. 1 is a schematic, elevational view of electroplating apparatus in accordance with the aforementioned Johnson application.

In FIG. 1 herein an elevational, highly schematic view appears of the electroplating apparatus 10 in accordance with the aforementioned Johnson application. It will be understood that the ensuing description of this Johnson invention, is being set forth for purposes of facilitating understanding of the improvements made by the applicants herein, and also in order to fully set forth those elements which are common to Johnson's apparatus, and to the present improvements.

Apparatus 10 is particularly adapted for use in electroplating of electronic components, such as the well-known TO-5 and TO-8 multi-lead headers which have heretofore been mentioned. The use of apparatus 10, as well as of the presently to be described improvements, will accordingly be particularly described with reference to such application, but it will become evident that such apparatus is utilizable (with suitable structural modifications in the conveying belts, etc.) with various other electronic components, as well as with other discrete objects as may require electroplating at selected portions thereof. Similarly, and as will also become apparent, while the apparatus considered in this specification is particularly valuable and intended for use in the plating of precious metals, particularly gold, there is no necessity whatsoever for so limiting its use, and accordingly electroplating solutions other than gold, as are known in the art, may be utilized therewith.

Electroplating apparatus 10 is seen to include a reservoir 12 for electroplating solution 14 carried therein. Reservoir 12, which is a simple tank of suitable materials as are compatible with and resistant to solution 14, is provided with pump means 16, having an inlet 18 from reservoir 12, and outlets 20 and 22 for returning the solution to the reservoir. Pump 16 serves primarily to provide continuous or semi-continuous agitation of the electroplating solution, and may be provided with filters, etc. for removing sediment or the like from the solution passing therethrough. Since apparatus 10, as has been previously indicated, is of particular use in gold electroplating applications, the solution 14 (although not per se comprising part of the present invention), commonly comprises an aqueous solution of an alkali-gold-cyanide, together with suitable buffering compounds, conductivity salts, and other agents as may be known in this art to be useful in promoting the production of high quality gold platings.

Positioned for cooperation with reservoir 12 is an electroplating solution applying means 24. Means 24 is based upon a plating belt 26, which is formed as a continuous loop, and passes about a series of rollers 28, 30 and 32, one or more of which may be driven by motor means (not shown in the present drawing). Plating belt 26, as seen in the enlarged view of FIG. 4, typically comprises a fabric backer 34 of Dacron or the like, to which is secured a fibrous nap 36, as for example, of Dynel. A structure of this type is basically similar to the applicator material of common paint rollers, and to similar means utilized in the past for applying decorative coatings to surfaces by contact therewith. In the present instance a primary consideration is, of course, that the specific fabric materials utilized, be compatible with the electroplating solution — i.e. not subject to attack thereby.

As is seen in FIG. 1, the lower portions of means 24 are beneath the surface 40 of plating solution 14, in consequence of which as the belt moves in the direction of arrows 42, a continuous supply of electroplating solution is brought to the electroplating station — which is generally designated at 44. The supply of electroplating solution on belt 26 is augmented by means of a duct 23, which discharges a portion of the pumped liquid through a nozzle 25, so that the liquid impinges on the belt as the latter approaches plating station 44. Discharge of electroplating solution in this manner, not only assures an abundant supply of same at the plating station, but moreover introduces such liquid at the relatively high temperatures of the reservoir 12 (which may be thus maintained by heaters or the like). These elevated temperatures are of considerable significance in achieving fully acceptable platings at station 44.

Figure 2:
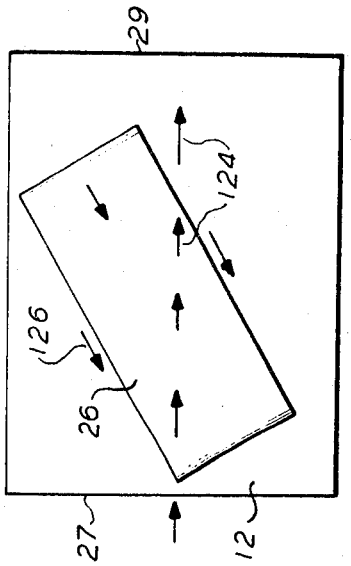
FIG. 2 is a schematic plan view, looking downward toward the electroplating solution reservoir, of the FIG. 1 device, and illustrating the relationship between the respective directions of movement of the plating belt, and of the components being plated by the apparatus.

Solution applicator means 24 is so mounted with respect to reservoir 12, that the direction of movement of belt 26 is not parallel to the plane of the drawing, but rather, as is apparent from the plan view of FIG. 2 herein, is skewed with respect to the said plane. Assuming that reservoir 12 thus has the rectangular geometry therein shown, it is apparent that the lengthwise orientation of belt 26, and its direction of movement 126, are skewed at an acute angle of the order of 60° with respect to the walls 27, 29 or reservoir 12, respectively depicted at the left and right sides of that structure.

In order to provide the anodic potential required at electroplating station 44, it is further seen that belt 26 as it progresses through the said station, passes in overlying relationship to an anode backing electrode 48, which may consist of a support plate 52 and an anode plate 50. The required positive potential for electrode 48 may be provided by means of a conventional D.C. power supply 54 which connects to plate 50 by means of a lead 56. Lead 56 may also connect through support plate 52 if the latter is suitably conductive and electrically continuous with plate 50.

A lower conveying belt means 58, preferably again in the form of a continuous loop, passes completely about the reservoir 12, and is guided by a series of rollers 60, 62, 64 and 66, one or more of which may be driven by conventional motor means (not shown in the drawing). These rollers rotate in the direction indicated by arrows 68. The configuration of belt means 58 is seen to be such that a portion 59 of the belt means passes essentially in a flat plane through electroplating station 44, at a position somewhat above a corresponding flat portion 27 of the solutioncarrying plating belt 26. Spaced slightly above the path of movement of belt means 58 at plating station 44, is a gripper belt means 70, which passes about the rollers 72 and 74, one or both of which may be driven by conventional motor means not shown in the drawing. These rollers progress in the direction indicated by arrows 76. Gripper belt means 70 includes a flat portion 71 at the region where means 70 passes through station 44. Finally, there is seen to be mounted for movement within belt means 70, a cathodic lead contact belt 82. This latter belt is also mounted upon a pair of guide rollers 83 and 84, which rotate in the direction of arrows 86. One or more of rollers 83 and 84 are driven by motor means, not explicitly shown in the present drawing. As is the case with belt means 26 and 70, belt 82 includes a portion 84 which passes through plating station 44, substantially in a plane. The motive means driving the aforementioned belt structures 70 and 82 are so geared or otherwise regulated, that the linear rate of progression of portions 71 and 84 are substantially equal at the plating station 44.

Figure 3:
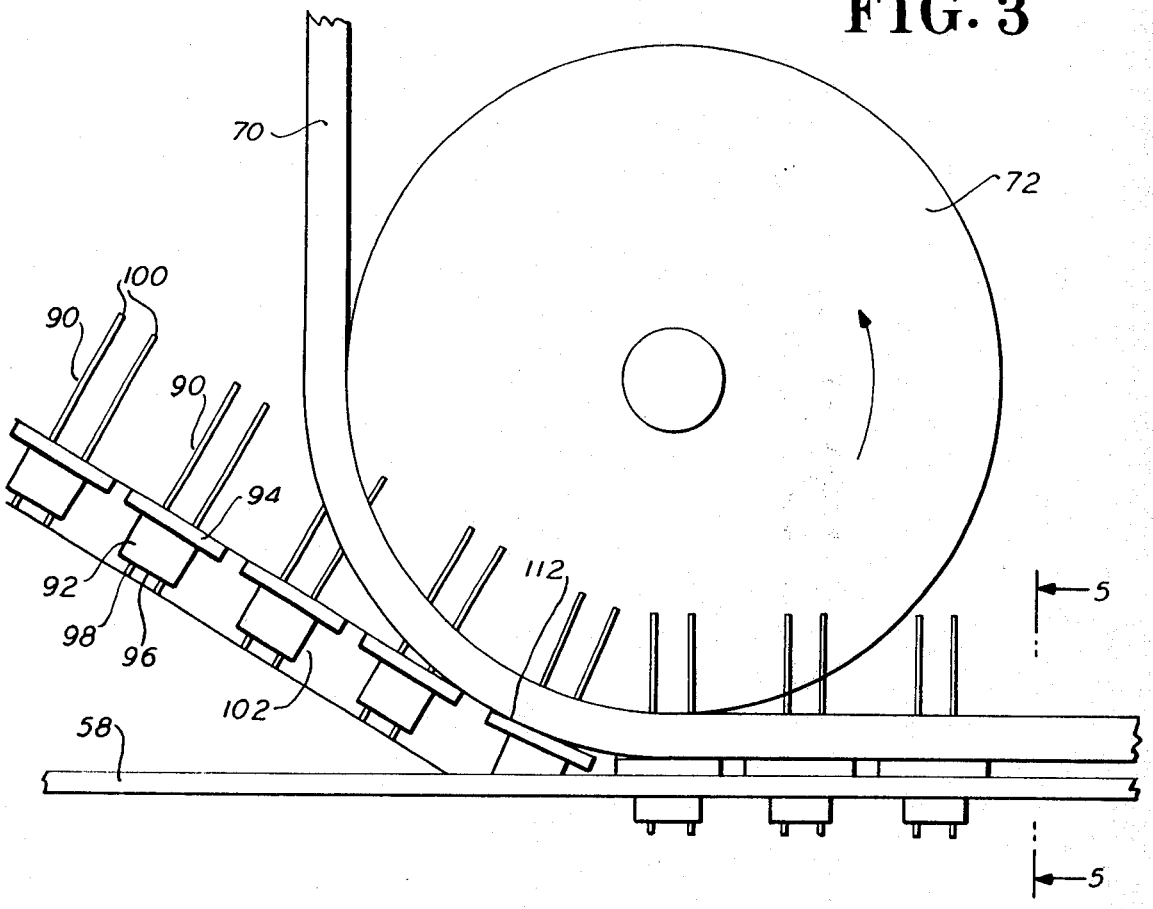
FIG. 3 is an enlarged view of a portion of the FIG. 1 apparatus, and illustrates the manner in which components to be plated by the apparatus are conveyed through the electroplating station.

Referring now to the enlarged schematic view of FIG. 3, the basic technique of conveyance for a series of components 90, is set forth. For purposes of concrete illustration, component 90 is deemed to constitute a multi-lead header of the type previously discussed herein. These headers are not shown in any great detail, in view of the fact that their construction is conventional and well-known. Such construction is seen, however, to include a body portion 92 provided with an enlarged lip or rim 94. The bottom of the header terminates at a die-receiving face 96. As is well known in this art, the face is surrounded by a plurality of terminal connections 98. In order to illustrate the invention more clearly, connections 98 have been exaggerated in scale — as have certain other attributes of the header, including the diameter of lip 94 in comparison to that of body 92. In point of fact connections 98 consist of a conductive terminal which is separated from the rest of body 92 by an insulating collar or the like. This type of structure, for example, may be seen at page 5 of the standard handbook "RCA Linear Integrated Circuits" (1970) available from the Solid State Division of RCA, Somerville, N.J. 08876. The several connections 98 are in electrical continuity with a corresponding number of leads, two of which are shown at 100. These leads are again exaggerated in scale for purposes of simplicity. In practice, and as is known in the art, (see e.g. the cited RCA reference) an integrated circuit chip or the like, is intended to ultimately be positioned at die-receiving face 96, with connections being made to the secured chip via the several connectors 98; thereafter the leads 100 enable (in the finished package) macroscopic connections to be made to the packaged chip.

The plurality of components 90 are fed into the present apparatus 10 in line form. The components may be arrayed by simple hand-feeding operations, or by simple automatic devices. For purposes of illustration a simple inclined track 102 is shown enabling a continuous in line feed of the said components. As the components descend to the bottom of track 102 they impinge upon and are supported by the belt means 58 discussed in connection with FIG. 1. Belt means 58 comprises an electrically conducive material, preferably a stainless steel. As is best seen in the detail cross-section of FIG. 5, taken along the line 5—5 of FIG. 3, belt means 58 is so constituted that an opening 104 is defined therein, which is appropriate to support the lip portion 94 of component 90 thereon. Preferably belt means 58 comprises two distinct stainless steel belts 106 and 108, which move parallel to one another at a common speed, whereby the spacing between the two belts 106 and 108 defines the said opening 104. By varying the lateral spacing between the two belts 106 and 108, the opening 104 may be rendered such as to support components of differing sizes. In actual practice, although exaggerated in the present drawing, the lip 94 projects very slightly from the remaining body 92 (in a typical header about 0.010 inch projection), so that the belts 106 and 108, which must be quite thin in order not to interfere with electroplating action, may be quite wide, for example, of the order of ¾ inch in width, in order to enable sufficient tensile strength at the points of support. This point may be better appreciated by noting in FIG. 3 that once the component 90 is supported on belt means 58 it is desired that the portions to be electroplated — specifically the face 96 and connections 98 — project below the plane of the belt means 58 to enable the said electroplating.

Belt means 58, constituting the two conductive belts 106 and 108 are rendered cathodic by means of wiping electrical contacts 110 connected to the negative side of power supply 54. Such wiping contacts may constitute conventional brush elements as are commonly utilized for these purposes, including without limitation metal brushes, graphite brushes, or the like; and similarly wiping contact plates, or so forth may be used.

Figure 5:
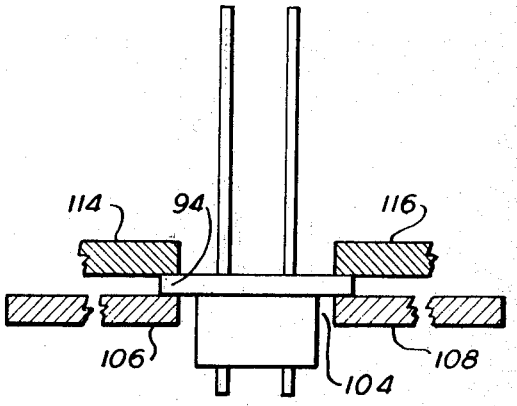
FIG. 5 is a cross-sectional detail view, taken along the direction 5—5 of FIG. 3, and illustrates the manner in which a typical component treated by the FIG. 1 apparatus is supported during its transport through the electroplating station.

In order to assure stability of the components 90 as they are conveyed through electroplating station 44, the upper or gripper belt means 70 engages an upper face of component 90, so as to sandwich the component in a firm manner as it passes through station 44. This action is best seen in FIG. 3 from whence it is noted that the belt means 70, preferably comprising a natural or artificial rubber such as neoprene, after passing about roller 72, is brought to bear upon the upper face 112 of body 92. Gripper belt means 70 may again comprise a pair of parallel moving laterally spaced belts 114 and 116, as seen in FIG. 5. These belts, like belts 106 and 107, are adjustable laterally with respect to one another (by being moved laterally on their rollers) so as to enable apparatus 10 to process components of differing widths.

Figure 4:
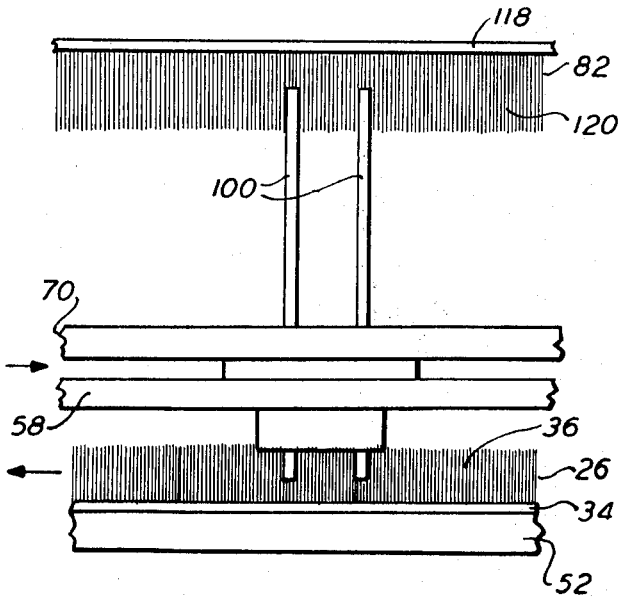
FIG. 4 is an enlarged view of a portion of the electroplating station of the FIG. 1 apparatus, and illustrates the manner in which the required electrical contacts are achieved at the station, and the technique by which electroplating solution is applied.

In FIG. 4, a considerably enlarged view is apparent of a component 90 passing through a typical mid-range point at station 44. In this view the function of the cathodic lead contact belt 82 becomes apparent. As is best seen in that Figure the said belt 82 preferably comprises a substrate 118 the material of which is preferably conductive, although non-conductive material can be utilized depending upon the nature of the flexible lead contact layer 120 secured thereto. The said flexible lead contact layer 120, may suitably comprise steel filaments or the like, or even appropriate grades of steel wool, etc. Similarly, the said layer 120 may suitably comprise a relatively flexible conductive rubber, such as graphite-impregnated neoprene or the like. The function of conductive layer 120 is to assure that a cathodic potential is provided to the terminal connections 98. Since, as has been previously indicated, these connections are actually insulated from the remainder of body 92, the negative electrical potential applied through wiping contact 110 is only useful in rendering face 96 cathodic. By applying, however, a potential to layer 120, as for example, by means of the wiping contact 122 (which is similar in structure to contacts 110, and which may engage with layer 120 where the elements of the layer are sufficiently intertwined to create electrical continuity, but which preferably engages the substrate 118, with that latter element being conductive) a potential is enabled to each of the leads 100, which in turn enables the negative potential at connections 98.

Returning now to the schematic depiction of FIG. 2, the full significance of the skewed directional movements between, respectively, the belt 26 and the progressing array of conveyed components 90, may be fully appreciated. Referring to that Figure the path of progression of components 90 is indicated by the trace of arrows 124 — which is the projection of the path of movement of the said components upon belt 26. Firstly, it is noted in that Figure that the general direction of movement 126 of belt 26 is opposed to the direction of movement of the components. As is best seen, however, by referring to FIG. 4, the basic scheme pursuant to which the desired portions (namely, face 96 and connections 98) are electroplated, involves passage of the said portions over the surface nap 36 of plating belt 26, whereby the electroplating solution carried by nap 36 contacts those portions of component 90 desired to be plated in the presence of a potential difference established by anode plate 34 and the cathodic potential applied either by belt means 58 or by flexible conductive layer 120. In order, however, for this process to be fully effectice, it will be appreciated that each of the successive components forming part of the array, should be brought into constant contact with fresh electroplating solution. Accordingly, by examination of FIG. 2, it will be apparent that effectice results will not be achieved were a given component to pass over a portion of belt 26 that had previously been depleted of electroplating solution by a component immediately preceding the one being considered. Accordingly, in order to assure that fresh solution is thus applied, the direction of movement of belt 26 is substantially skewed with respect to the trace of arrows 124. The precise angularity of skewing will, of course, be a function of the velocity of relative movement of the belt 26 and of the conveying belts 58 and 70 which advance the components 90, as well as of the spacing between components; but the several elements will be interrelated so that a condition is achieved, whereby successive components in the advancing array are not brought into contact with areas on the belt 26 previously depleted of solution by other components. As has already been discussed, and as is apparent in FIG. 2, a representative and useful degree of skewing is an angle of the order of from about 150° to 135° between the two directions of advance; but angles of greater than 150° may be used depending upon the factors previously mentioned, and angles to at least 90° or less may be effectively utilized.

While apparatus 10 has been particularly illustrated for the simple case where a single aligned array of components is advanced into the apparatus, it will be apparent that multiple, parallel component lines can be treated by substantially similar apparatus and methodology. In these further cases, however, multiple groupings of conveying belts, and as required multiple electrical contacts, are utilized, in order to assure similar results.

Figures 6, 7:
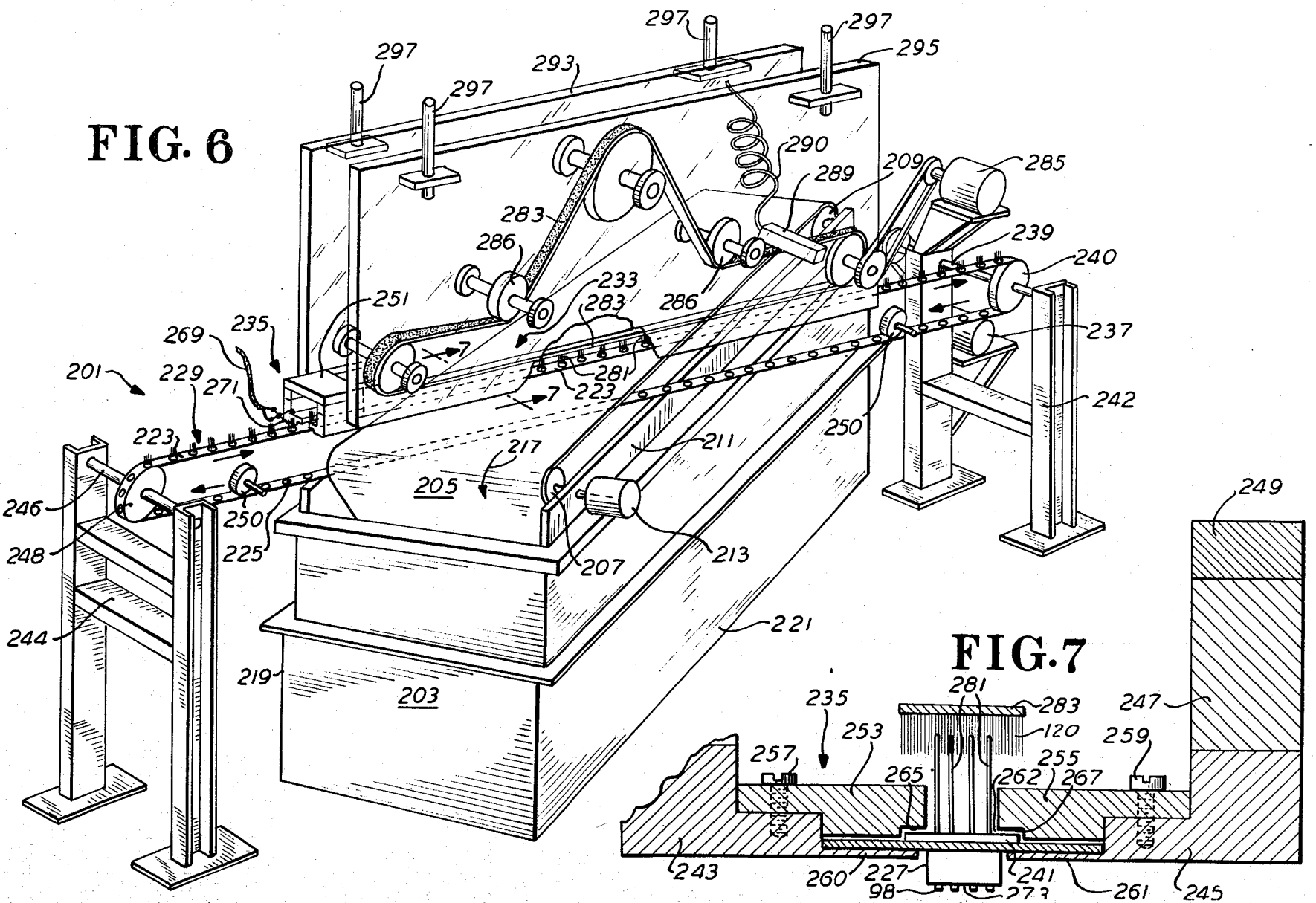
FIG. 6 is a perspective view of a first embodiment of improved electroplating apparatus in accordance with the present invention.
FIG. 7 is a cross-sectional view of the conveyor belt guide taken along the direction 7—7 of FIG. 6, and illustrates the manner in which components to be treated in the machine are conveyed in and through the said guide, as well as the manner in which contact is effected with the cathode lead belt.

In FIG. 6 a perspective, somewhat simplified view appears, of apparatus 201, in accordance with the present invention. Apparatus 201 in gross mode of functioning resembles the Johnson apparatus heretofore described, with the important improvements that will be evident.

Apparatus 201 thus includes a reservoir tank 203 for electroplating solution which is carried therein. An electroplating solution applicator belt 205 is mounted about a plurality of rollers, two of which are seen at 207 and 209. The rollers may be three in number, as for example, is illustrated in the arrangement of FIG. 1, heretofore described. The roller may be journaled for rotation as, for example, by being mounted on axes supported by tank frame members 211; and one or more motive elements, as for example, the electric motor 213, may be provided for enabling continuous movement of the applicator belt in a manner that has been described in connection with FIG. 1. In view of the FIG. 1 showing, it will be understood that the lower portions of the applicator belt pass through the electroplating solution contained within tank 203, and thus the said belt is continuously wetted by the solution. Further, and although not shown, in order to simplify the present Figure, a duct — as at 25 in FIG. 1 — is provided for distributing additional electroplating solution at the portions of the belt progressing from roller 209 toward electroplating station 233. This duct may take the form of a tubular header provided with multiple openings, which header can extend the width of the belt, parallel to but slightly spaced from the belt and roller, and continuously distribute the plating solution in sprinkling fashion. The header is provided with its supply of electroplating solution by means of a pump (as at 16 in FIG. 1), positioned at the bottom of tank 203, which pump serves the additional purpose of continuously agitating the electroplating solution. An electric, or other energized heater, is also commonly present in the tank for maintaining the electroplating solution at a desired temperature level.

It will be noted that belt 205, is oriented at the same direction as the walls of tank 203, differing in this respect from the arrangements in FIGS. 1 and 2. In accordance with the principles of the present invention, and similar to the arrangement in the aforementioned Johnson apparatus, the components to be treated by apparatus 201 are passed in array across applicator belt 205, at a skewed direction with respect to the direction 217 of advance of the applicator belt. In the present device, however, the skewing is achieved by angling the direction of advance of the components with respect to the lateral walls 219 and 221 of tank 203, as opposed to the FIG. 2 arrangement — wherein the belt advance direction is skewed, while the direction of advance of the components is parallel to the walls of the plating solution tank.

The conveying means in the present apparatus 201 comprises a conveying belt 223, which is formed as a closed loop. Belt 223, as seen both from FIG. 6 and the partially sectioned view of FIG. 7, includes a series of circular openings 225, which are adapted to hold components 227, inserted into such openings at the region 229 — that is, in the region before belt 223 reaches plating station 233. The components may be thus loaded by known devices, including inclined tracks as in FIG. 3, or manual loading is possible. Belt 223 may comprise a stainless steel or similar material. Since, as will be discussed in connection with FIG. 7, belt 223 progresses through a guide 235 in which it is slidingly received, the belt 223 may be coated with a material such as teflon to provide a self-lubricating face for the belt where it contacts the adjacent faces of guide 235. Motive power enabling progression of belt 223 is provided by an electric motor 237, which connects through a belt and pulley arrangement to the drive shaft 239 for guide roller 240. Drive shaft 239 is journaled in a support frame 242. A second support frame 244 at the opposite end of apparatus 201 journals a shaft 246 for an idling roller 248. Guides and tension take-up rollers are also provided at 250.

Component 227, best seen at FIG. 7, may be regarded as identical with component 90, which has previously been described in connection with FIGS. 3, 4 and 5. Component 227 nests in the openings 225 so that the lip or rim 241 of such component, rests upon belt 223, as the latter passes through guide 235.

Guide 235 includes a pair of longitudinally extending base members 243 and 245; a pair of vertical members 247; a pair of longitudinally extending upper rails 249; and cross-connecting top pieces, respectively at the front and rear ends of the guides, one of which is seen at 251 (FIG. 6). A pair of channel pieces 253 and 255 are joined to inwardly extending portions of members 243 and 245 by fasteners 257 and 259; although not thus shown, the pieces 253 and 255 may include laterally enlarged unthreaded openings for passage of fasteners 257 and 259, so as to enable a degree of adjustment in the spacing of pieces 253 and 255, or other means known in the art may be utilized for this purpose; similarly pieces 253 and 255 may be interchanged with other paired pieces having openings for passage of fasteners 257 and 259 at appropriate positions to yield a desired spacing between pieces 253 and 255 — for purposes that will become apparent.

It is seen that the pieces 253 and 255 cooperate with the inwardly extending portions 260 and 261 of members 243 and 245 to define a longitudinally extended channel 262, through which the belt 223 may pass in its course of progression. It will be further noted that pieces 253 and 255 include shoulder portions 265 and 267, which are in opposition to the lip or rim 241 of the components being conveyed.

It will next be noted that an electrical connecting cable 269 (FIG. 6) terminates at a clamp 271, which enables a negative electrical potential to be provided to guide 235. In accordance with the configuration shown in FIG. 7, electrical potential is enabled to the body of component 227 by contact made between shoulders 265 and 267 and the opposed lip 241 of the component. It will be noted in FIG. 7 that a slight clearance appears to exist between the thus opposed elements. It should be understood, however, that such clearance is shown for purposes of simplification only. In actual practice it will be thus appreciated that as the components are moved through plating station 233, the die-receiving face 273 of component 227 is brought into contact with the adjacent face of solution applicator belt 205, in a manner that has already been discussed in connection with FIGS. 3 through 5. According, it will be evident that a degree of upward pressure is provided at face 273, and due additionally to the slight flexures and other small displacements as the belt 223 moves, a sliding electrical contact is in fact maintained between lip 241 and shoulders 265 and 267. Since different electrical components may be possessed of slightly differing thicknesses in their lip portions 241, shims may be inserted at the interfaces between pieces 253, 255 and members 243, 245 — to enable the required accommodation.

It will be evident by considering the FIG. 7 enlarged depiction, that as the components 227 pass through guide 235, they are restrained from wobble about their vertical axis by the closely fitting walls of channel 262 through which they pass. Since, further the entire guide 235 is a rigid structure, die-receiving face 273 (including contacts 98) is very accurately positioned and maintained with respect to the solution-carrying surface of belt 205.

As already discussed, the width of channel 262 may be adjusted to accommodate components of differing widths; and similarly shims may be provided at the interfaces 242 between pieces 253 and 255 and members 243 and 245, in order to compensate for differing thicknesses of the lip portion 241 where differing components are treated in the apparatus.

The channel 262 is further seen, to be open at it upper end, and the leads 281 protrude upwardly as the component 227 passes through electroplating station 233. In accordance with principles previously discussed, it is necessary to effect electrical contact with the said leads (except where the leads are grounds) in order to assure that the otherwise-insulated connecting contacts 98 at die-receiving face 273 are provided with electrical potential. In the present apparatus this is enabled through use of a lead contact belt 283. Belt 283, as seen in FIG. 6, is in the form of a closed loop, the bottom portion of which closely overlies and parallels on conveyor belt 223 in the space between top pieces 251 at electroplating station 233. Lead contact belt 283 passes about various rollers 286 in its course of progression, is driven by a motor 285 through a belt and pulley arrangement as seen. The externally facing portion of belt 283 may be identical to belt 82, previously discussed in connection with FIGS. 1 and 4, and thus may include an insulating carrier piece such as at 118 in FIG. 4, and a flexible conductive surface, such as a conductive wire mesh similar to that shown at 120 in FIG. 4. Lead contact belt 283 moves in direction 287 at approximately the speed of progression of conveyor belt 223, so that component 227 as it moves through the station 233 is in good contact with the conductive surface of such belt, while at the same time the leads 281 are subjected to little physical stress. Electrical potential to the conductive surface of belt 283 is provided by a sliding electrical contact means such as a metal surfaced brush 289 which is provided with its potential through lead 290. Support for the entire assembly associated with lead contact belt 283 may be through the side plates 293 and 295, which in turn depend from overhead support members 297. The latter may be roof-supported in such fashion as to be vertically adjustable, thereby to enable a degree of upward or downward movement of side plates 293 and 295. This, in turn, enables adjustment in the spacing of lead contact belts 283, from pieces 253 and 255, which in turn enables some adjustment for lead lengths, or so forth.

Figure 8:
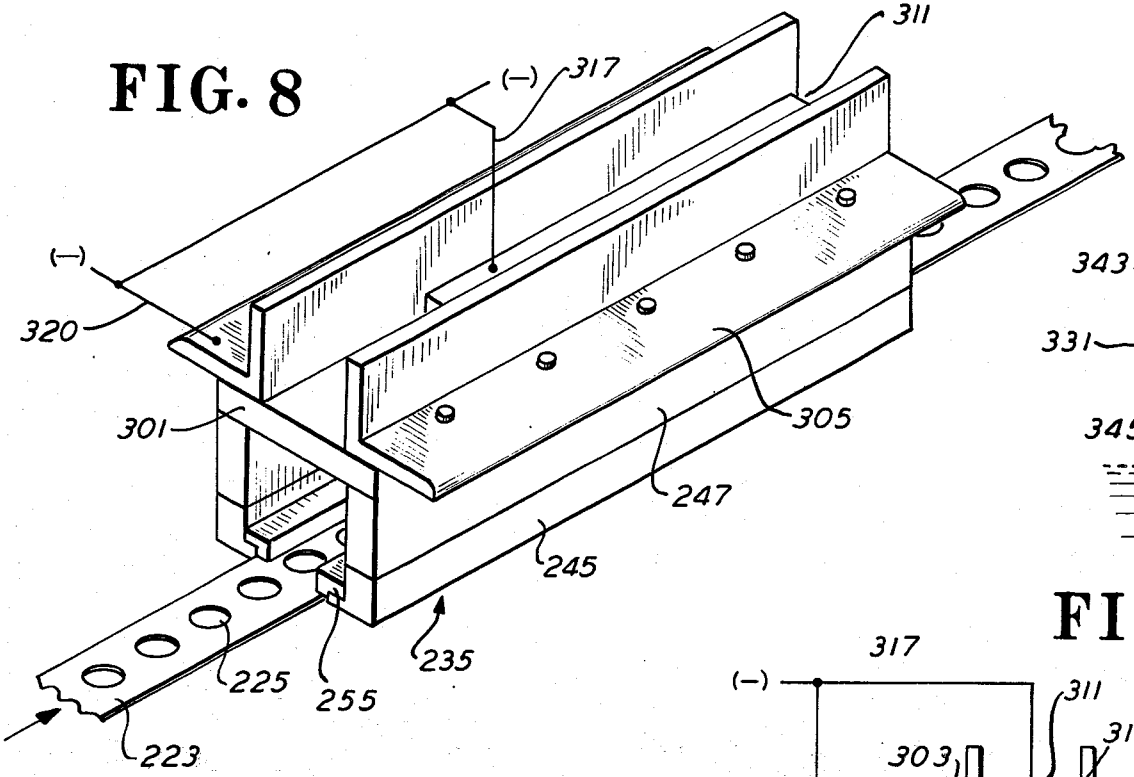
FIG. 8 is a perspective view of the conveyor belt guide and of the associated lead contact brush useable in accordance with a second embodiment of the present invention.
Figure 9:
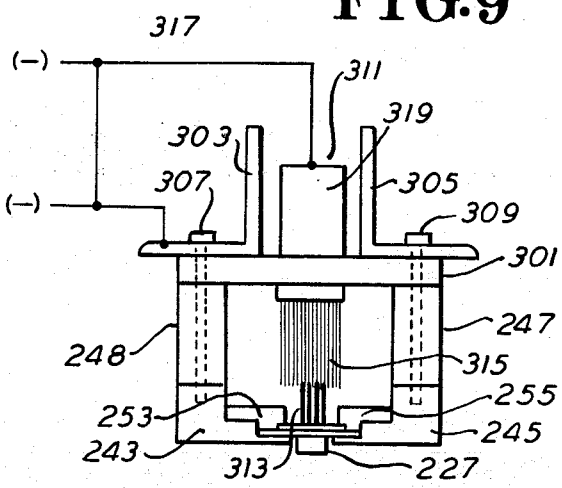
FIG. 9 is an elevational view of the components illustrated in FIG. 8.

In FIGS. 8 and 9, perspective and end elevational views appear of a second embodiment of the present invention. This second embodiment of the invention differs from that so far discussed, principally with respect to the lead contact means utilized. In particular it will be appreciated that the FIGS. 6 and 7 embodiment is based upon use of a moving lead contact belt 283. Such belt introduces a certain degree of complexity into the present system by virtue of the requirement for the looped belt itself, for the various journaling means for allowing continuous movement thereof, and of course for the source of motive power.

In accordance with the teachings of FIGS. 8 and 9, the requirement for a moving contact belt is obviated. Referring thus to the perspective view of FIG. 8, a conveying belt 223 (corresponding to the element identically numbered and already discussed) is shown advancing into a conveying belt guide 235. The latter is also basically similar in structure to the corresponding element of FIGS. 6 and 7. Components such as at 227 in FIG. 9, are conveyed in circular openings 225 of belt 223. A cover piece 301 is secured to the tops of side members 247 and 248 of guide 235. A pair of upper flange members 303 and 305 are, in turn, secured to cover piece 301, as for example by bolts 307 and 309.

In the present arrangement a stationary brush contact means 311 is inserted and secured through a lengthwise-extending opening in cover member 301, so that the flexible conductive element secured to the brush may contact the leads 313 of component 227 as the component moves through guide 235. Flexible conductive means 315 may take the form of fine brass wire or similar filamentry or other flexible material, which as the components advance, permits the leads 313 to readily engage therewith on a virtually continuous basis, with however the flexible conductive means yielding as the component moves so as not to seriously distort or bend the said leads. Electrical contact with brush means 311 may be made by a lead-in 317 which connects to a conductive support base 319, for the stationary brush. Similarly it is seen that a parallel electrical lead-in 320 may connect to the conductive flange members 303 and 305, to assure good electrical contact with the guide 235 proper, thereby assuring that an electrical potential is properly applied to the body of component 227 — as opposed to the leads 313 and their associated contacts.

While not explicitly shown in connection with FIGS. 8 and 9, means may be provided to enable a degree of horizontal adjustment in the spacing of pieces 253 and 255 to enable accommodation of components having differing widths for their lip portions — as has already been described in connection with FIGS. 6 and 7. Similarly, shims may be inserted between pieces 243, 245 and members 253 and 255, in order to enable accommodation of lips of various thicknesses on the said components.

Figure 10:
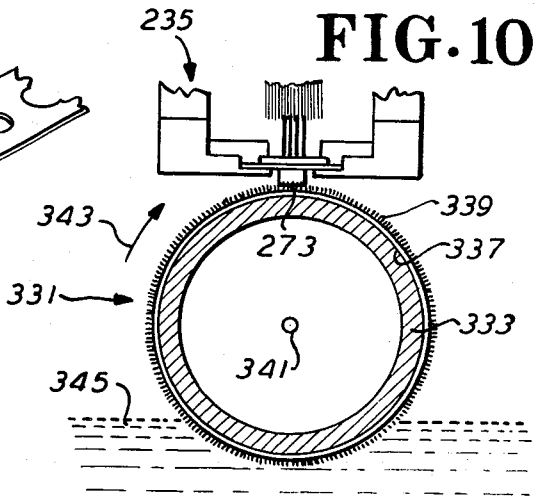
FIG. 10 is an elevational, partially sectioned view of apparatus in accordance with the invention, utilizing a roller-shaped body for application of electroplating solution to the components being treated.

In accordance with a further aspect of the present invention, the electroplating solution applicator means may be further simplified according to the showing of FIG. 10. In FIG. 10 there thus appears an elevational, partially sectioned view of apparatus in accordance with the invention, but utilizing a roller-shaped applicator 331 for application of electroplating solution to the components being treated. The apparatus depicted in FIG. 10 may be regarded as including the component conveying means and guide means heretofore discussed in connection with FIG. 6, with it being assumed, further, that the stationary lead contact brush arrangement of FIGS. 8 and 9 is utilized; thus, the bottom-most portions of the FIG. 9 showing appear in the simplified FIG. 10 view. Roller applicator 331 is seen to include a conductive cylinder 333, which can comprise a metal composition resistive to anodic attack during the plating operations. For example, cylinder 333 may comprise tantulum or titanium, overclad or otherwise provided with a platinum coating; or a mesh of similar composition can be used. Atop and surrounding the cylinder, a fibrous sleeve 335 is provided of basically the same materials as have been discussed in connection with the applicator belt 26 of FIG. 4. This is to say that the sleeve may include a fabric backing member 337 with a fibrous covering 339 of Dynel or so forth.

Applicator 331 may be so mounted for rotation about its axis 341, so that the bottom portions of the cylinder pass through the reservoir 345; thereby enabling continuous application of electroplating solution as the applicator 331 is made to rotate in direction 343, as for example, by means of a motor element (not shown). Electroplating solution can also be applied to the applicator surface by other means — which can supplement or replace direct contact with the reservoir. For example, solution can be sprayed upon the applicator surface by a suitable header which receives a pumped supply of solution from reservoir 345. All of these methods results in providing a plentiful supply of electroplating solution to the applicator surface at points in its progression which are upstream of the electroplating station.

The particular orientation of axis 341 with respect to tank 203 (FIG. 6) is not of great significance. With a tank geometry as in FIG. 6, axis 341 can, for example, be oriented parallel to sides 219 and 221 of the tank — with the relative angle between tank 203 and the component conveying system being adjusted as to render the direction of component conveyance parallel to axis 341 through electroplating station 233.

Applicator 331 is preferably oriented so that axis 341 is parallel to the direction of conveyance of the components being plated. The diameter of cylinder 331 is sufficient, that as a component 227 moves in the indicated direction, the die-receiving face 273 thereof, substantially sees a flat surface — which is to say that the curvature of cylinder 333 is sufficiently low in relationship to the diameter of the face 273 (and additionally, the nap of covering 339 is sufficiently long) that all portions of face 273 are contacted as the component is conveyed. The rate of rotation of the cylinder, in comparison to the rate of progression of the components, is rendered such that the trace of the said component upon the solution-bearing surface of the applicator continuously overlies fresh electroplating solution. During the operation plating, the anodic potential is applied to cylinder 333 by means of a sliding electrical contact — e.g. a brush — which contacts the internal surface of the cylinder or an edge thereof.

While the present invention has been particularly described in terms of specific embodiments thereof, it will be understood in view of the present disclosure, that numerous variations upon the invention are now enabled to those skilled in the art, which variations yet reside within the scope of the present teaching. Accordingly the inventuon is to be broadly construed, and limited only by the scope and spirit of the claims now appended hereto.

We claim:

1. Apparatus for continuous electroplating of selected portions of discrete electronic components of the type comprising an electrically conductive body having a die-receiving face, a lip portion formed above said face of greater diameter than said face, and a plurality of electrical contacts formed as insulated islands at said die-receiving face, with flexible wire leads being connected to at least some of said contacts and extending oppositely from said die-receiving face and beyond the body of said component, but at least some of said leads being electrically insulated from said body and from one another; said selected portions to be electroplated being said die-receiving face and at least some of said electrical contacts; and said apparatus comprising:

an electroplating station;

a moveable applicator means adapted for carrying electroplating solution on the surface thereof;

means for continuously moving at least a portion of said applicator means surface through said electroplating station;

means for applying electroplating solution to said applicator means at a point in the progression thereof, upstream of said electroplating station;

conveyor belt means for receiving said component bodies and supporting same at said lip portions so that said die-receiving faces of said electrical components project beneath the plane of said belt;

a stationary conveyor belt guide means mounted in fixed spaced relationship above said moving applicator means, and having a lengthwise channel therethrough through which said conveyor belt means passes, said channel including means for restraining the movement of said components other than in the direction of conveyance of said conveyor belt, the said components being thereby conveyed across the surface of said applicator means, with the downwardly projecting die-receiving face and electrical contacts of said components in contact with said electroplating solution on said applicator means;

the direction of movement of said conveyed components through said guide being such in relationship to said movement of said applicator means that the trace of each said component on the surface of applicator means continuously overlies fresh electroplating solution; and means for applying a D.C. electrical potential between both said die-receiving face and the leads connected to the electrical contacts to be plated, and the side of said applicator means opposite said component, to enable said plating.

2. Apparatus in accordance with claim 1, including flexible electrically conductive means for contacting said extending wire leads of said components; and means for applying the cathodic side of said potential to said lead contact means.

3. Apparatus in accordance with claim 2, wherein said applicator means comprises a continuous belt.

4. Apparatus in accordance with claim 2, wherein said applicator means comprise a roller, and means for rotating said roller about the axis thereof.

5. Apparatus in accordance with claim 4, including a reservoir for said electroplating solution, and wherein said roller is positioned with respect to said reservoir so that a portion thereof passes into said reservoir during rotation; thereby to apply said electroplating solution to the roller surface.

6. Apparatus in accordance with claim 4, wherein said roller is oriented so that the axis thereof is substantially parallel to the direction of conveyance of said components through said electroplating station.

7. Apparatus in accordance with claim 2, wherein said flexible conductive means comprises: a conductive-surfaced lead contact belt formed as a loop, with a portion of said loop at said electroplating station being parallel to and in overlying relationship from said channel of said guide; means for continuously moving said lead contact belt through said electroplating station so that the conductive surface of said belt moves at approximately the speed of progression of said components and in contact with said leads; and means for providing said cathodic potential to the surface of said lead contact belt to render said leads and thereby said associated contacts at the plating potential.

8. Apparatus in accordance with claim 2, wherein said flexible conductive means comprises a stationary conductive lead contact brush positioned at said plating station so that said components passing through said station are in contact with said brush through at least a substantial part of their progression through said station, to thereby enable a plating potential at said leads and the associated contacts at the die-receiving faces of said components.

9. Apparatus in accordance with claim 8, wherein said brush comprises a base, conductive fine wire secured to said base and extending outwardly therefrom for contacting said leads; and means for applying said potential to said fine wire.

10. Apparatus in accordance with claim 1, wherein said guide channel means for restraining said component movements includes guide surfaces opposable to said lip portions of said components.

11. Apparatus in accordance with claim 10, wherein said electrical potential is applied to said components at least partially through contact between said guide surfaces and said lip portions.

12. Apparatus in accordance with claim 10, wherein said conveyor belt means comprises a continuous strip having longitudinally spaced circular openings therein for receipt of said components.

13. Apparatus in accordance with claim 11, wherein said conveyor belt means comprises a continuous strip, the surface of which is provided with a low friction, electrically insulating coating.

14. Apparatus in accordance with claim 10, wherein the respective spacing of said guide surfaces from said component portions is adjustable, to enable accommodation of various-sized components.

* * * * *